US007108131B2

(12) United States Patent
Dreher et al.

(10) Patent No.: US 7,108,131 B2
(45) Date of Patent: Sep. 19, 2006

(54) CASE, PARTICULARLY A MACHINE TOOL CASE

(75) Inventors: Ernst Dreher, Reutlingen (DE); Juergen Stoeger, Neckartailfingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/250,729

(22) PCT Filed: Dec. 19, 2002

(86) PCT No.: PCT/DE02/04656

§ 371 (c)(1),
(2), (4) Date: Jul. 9, 2003

(87) PCT Pub. No.: WO03/055648

PCT Pub. Date: Jul. 10, 2003

(65) Prior Publication Data

US 2004/0055915 A1 Mar. 25, 2004

(30) Foreign Application Priority Data

Dec. 21, 2001 (DE) ..... 101 63 439

(51) Int. Cl.
*A45C 11/26* (2006.01)

(52) U.S. Cl. ..... 206/349; 312/902

(58) Field of Classification Search ..... 144/1.1, 144/285, 286.1, 286.5, 287; 206/305, 320, 206/315.11, 349, 351, 372, 373; 312/902
See application file for complete search history.

(56) References Cited

U.S. PATENT DOCUMENTS

| | | | | | |
|---|---|---|---|---|---|
| 2,697,460 | A | * | 12/1954 | Barnett | 144/285 |
| 2,786,500 | A | | 3/1957 | Unterfranz | |
| 3,371,975 | A | * | 3/1968 | Meltzer | 55/385.1 |
| 4,160,570 | A | * | 7/1979 | Bridges | 312/245 |
| 4,252,239 | A | * | 2/1981 | Snyder | 206/349 |
| 4,276,799 | A | * | 7/1981 | Muehling | 83/473 |
| 4,483,573 | A | * | 11/1984 | Keller | 312/281 |
| 6,082,539 | A | | 7/2000 | Lee | |
| 6,113,202 | A | * | 9/2000 | Germano | 312/245 |
| 6,209,597 | B1 | * | 4/2001 | Calcote | 144/329 |

FOREIGN PATENT DOCUMENTS

| | | |
|---|---|---|
| DE | 7212603 | 10/1972 |
| DE | 84 27 020 U | 12/1984 |
| DE | 298 05 365 U1 | 8/1998 |
| GB | 711284 | 6/1954 |

* cited by examiner

*Primary Examiner*—Jila M. Mohandesi
*Assistant Examiner*—J. Gregory Pickett
(74) *Attorney, Agent, or Firm*—Michael J. Striker

(57) ABSTRACT

The invention is based on a case, in particular a power tool case, having a housing (10, 12) that has at least one housing part (46, 48) with a storage space (14) for carrying and/or storage of a power tool (18), in particular a manual power tool.

It is proposed that the housing (10, 12) forms at least of a part of a base (20) to stand on for a stationary operating mode of the power tool (10).

17 Claims, 6 Drawing Sheets

CASE, PARTICULARLY A MACHINE TOOL CASE

BACKGROUND OF THE INVENTION

The invention is based on a case, in particular a power tool case.

From German Utility Model DE 84 27 020.9 U1, a case with a housing made of plastic is known; the housing has a housing part with a storage space for carrying and/or storing various manual power tools. Space-partitioning and support elements formed by struts are formed onto the housing part and protrude into the storage space.

SUMMARY OF THE INVENTION

The invention is based on a case, in particular a power tool case, having a housing that has at least one housing part with a storage space for carrying and/or storage of a power tool, in particular a manual power tool.

It is proposed that the housing forms at least of a part of a base to stand on, in particular a retaining device, for stationary operation of the power tool. The housing can advantageously be used as a carrying container or as a base to stand on for the power tool during the stationary operating mode. Particularly when the case of the invention is used in manual power tools, such as planes, saber saws, circular saws, etc., which can be used in fixed fashion, additional expensive frames can be avoided, and expenses, particularly for accessory parts for the power tools, can be reduced. The weight that has to be transported can also be reduced.

According to the invention, the case can be part of a frame, on which a receptacle for the power tool can be secured, or it can advantageously have at least one receptacle region, in which the power tool can be fixed for the stationary operating mode. With only a few additional components, safe stationary operation can be achieved in the receptacle region of the housing. The receptacle region can be formed by a separate component secured to the housing, or advantageously it can be integrally formed onto the housing, especially if the housing is produced from plastic.

The case can be set down on a floor or on an elevated shelf. However, it is also possible for the housing to have receptacle capabilities for a separate frame or for separately mountable feet to stand on, so that comfortable work can always be assured.

Advantageously, the housing has at least one switch device for actuating a switch, in particular an on and off switch, of the power tool. In the stationary operating mode, the power tool can be operated and switched on and off safely, simply and comfortably via the switch device, without having to release the power tool from its anchoring.

In a further feature of the invention, it is proposed that the switch device has a rigid shaft. Especially advantageously, the rigid shaft can be subjected to tensile and compressive stress, and an especially simple switch device for switching the power tool on and off can be achieved. The switch device for switching the power tool on and off can, however, also be realized by other components appearing useful to one skilled in the art, such as a flexible shaft, a cable system, electronic components, etc. If the switch device has electronic components, then it can especially simply be equipped with an additional pushbutton element, such as a foot button, and when the power tool is used in the stationary operating mode, an additional safety function can be attained, in which the power tool can be switched off for instance by releasing the switch element.

It is also proposed that the switch device has a spring element, counter to whose spring force a control element of the switch device can be moved. Upon release of the control element, the switch device can be moved into its outset position by the spring force of the spring element, and fast and safe shutoff of the power tool is attainable in particular. The switch device can be used structurally simply and economically as a safety device, in particular as an emergency off switch.

Advantageously, the switch device snaps into a detent unit in at least one end position. Constant actuation of the control element by a user can be avoided, and a workpiece to be machined can be guided securely by the user over the power tool using both hands. If the detent unit is formed by at least one part of the housing, then existing components can advantageously be used, and both additional components and additional weight can be avoided.

In principle, the power tool can be secured to the housing via separate fastening elements, for secure stationary operation. However, if in the stationary operating mode the power tool is secured to the housing via the switch device, then existing components can advantageously be used and additional fastening elements can be avoided. Expenses, particularly production costs, can be lowered, and weight can be saved.

Advantageously, at least one element of the housing actuates an unlocking button of the power tool, during the stationary operating mode of the power tool. A simple, economical device for unlocking the switch of the power tool can be achieved, and the power tool can be switched on and off especially simply via the switch device.

Advantageously, the housing has at least one means that prevents mispositioning of the power tool in the housing. A simple safety device for protecting the user can be achieved, in which the means can be formed by at least one part of the receptacle region of the power tool. Existing components can advantageously be used, and weight and installation space can be saved. If the means is combined with a control element for selecting a chip ejector, especially in planing machines, then a user can be safely protected against ejected chips and/or foreign particles.

In a further feature of the invention, it is proposed that the housing has at least one recess, by way of which at least one control element of the power tool is actuatable. As a result, during the stationary operating mode, various parameters can be set simply in the power tool, such as a planing depth, cutting depth, cutting width, and so forth, without having to remove the power tool from its stationary mount. Manipulating the power tool can be simplified, the setup time can be shortened, and the ease of use of the power tool in the stationary operating mode can be enhanced.

Especially advantageously, when the housing is closed, the recess is closed by at least one element that corresponds with the recess. Advantageously, the recess can be closed automatically when the case is closed, and the power tool can be protected against outside influences. The element can be formed by separate component or can be integrally formed onto the housing. If the element is integrally formed onto the housing, then components, weight and production costs can all be reduced.

If besides a first housing part, the housing has a second housing part, which parts are joined to one another in hinged fashion and have the same height, then in the folded-open state of the first and second housing parts, a stable device can be achieved in which a large footprint to stand on and/or work surface can be attained with a housing bottom of the first and second housing parts.

If the first and second housing parts are fixed relative to one another in the folded-open state, an intrinsically stable device can be achieved especially advantageously.

It is also proposed that at least one accessory part of the power tool is integrated with the housing. The accessory part can be secured carried about and stored in the housing. Accessory parts for mobile operation and/or especially advantageously accessory parts for stationary operation can be integrated with the housing, examples being an electrical socket, a covering for a planing knife, a chip collector, and so forth.

In a further feature of the invention, it is proposed that the housing has at least one device for joining it to at least one further housing. Advantageously, a plurality of housings of different power tools can be combined into a unit, in order to attain an enlarged work surface and/or to be joined together to form an equipment cabinet. Both the storage space and expenses can be reduced.

BRIEF DESCRIPTION OF THE DRAWINGS

Further advantages will become apparent from the ensuing drawing description. One exemplary embodiment of the invention is shown in the drawing. The drawing, description and claims include numerous characteristics in combination. One skilled in the art will expediently consider the characteristics individually as well and put them together to make useful further combinations.

Shown are.

DETAILED DESCRIPTION OF THE PREFERRED EMBODIMENTS

Figure 1:
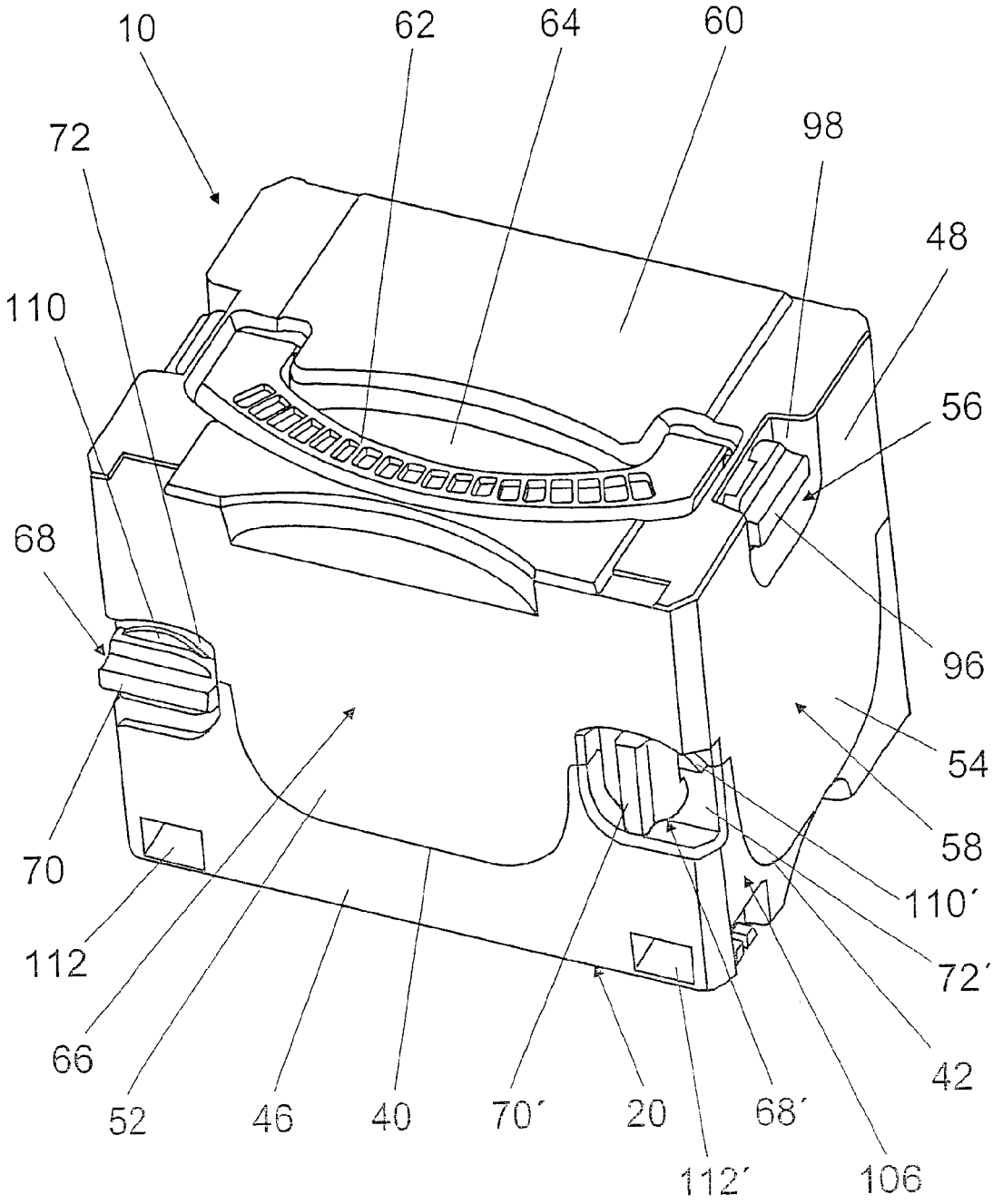
FIG. 1, a case according to the invention for a manual power tool, in the closed state.
Figure 2:
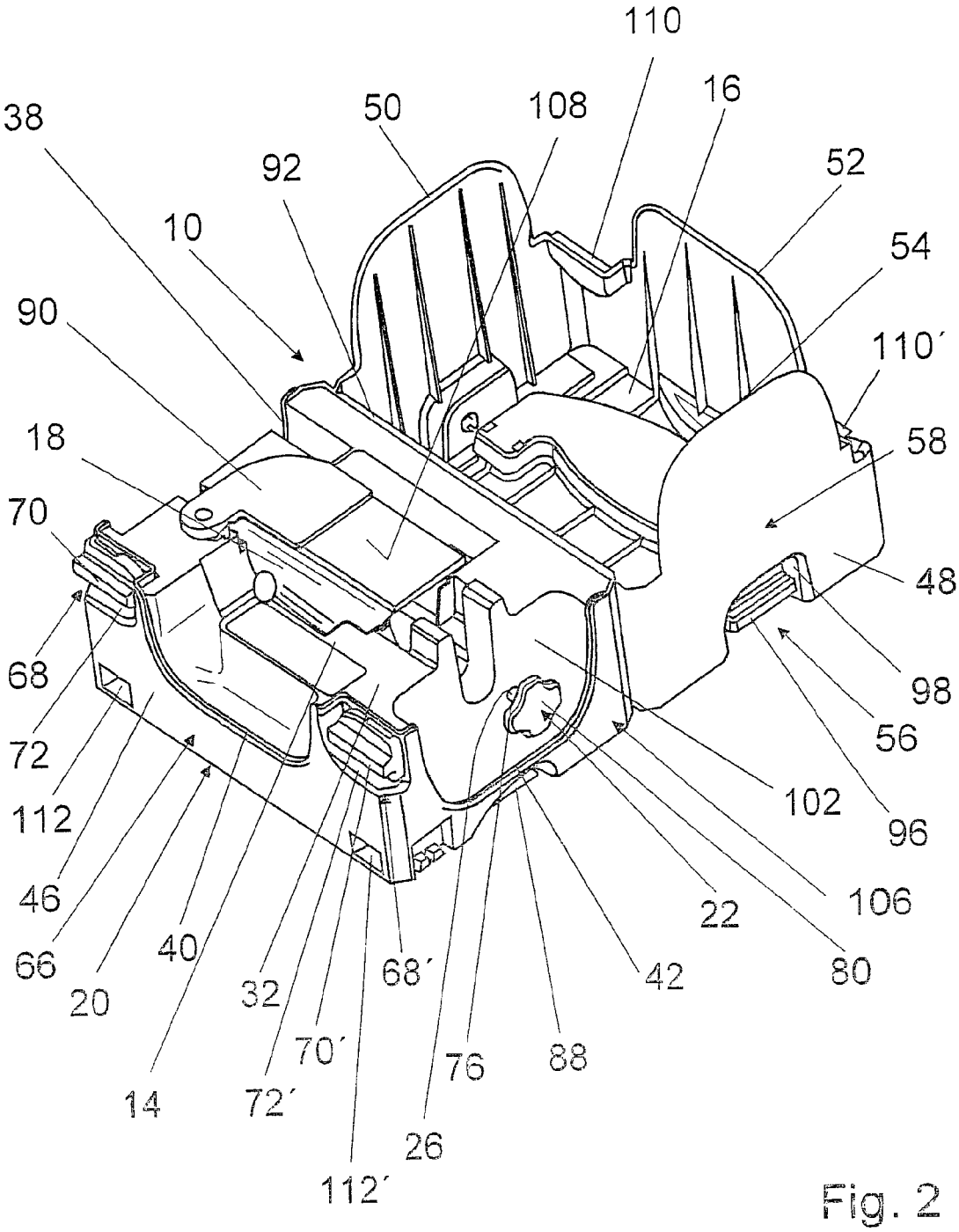
FIG. 2, the manual power tool case of FIG. 1 with a manual pow tool in an operating position for stationary operation.

FIG. 1 shows a housing 10 of a closed manual power tool case according to the invention, with a first and a second housing part 46, 48, which in the folded-open state are the same height (FIG. 2). A curved carrying handle 62 (FIG. 1) is secured to a top wall 60 of the second housing part 48 and is joined in hinged fashion to the second housing part 48. In the folded-closed state, the carrying handle 62 is sunk in an indentation 64 formed into the top wall 60, and with its side pointing upward in FIG. 1, the carrying handle is flush with an upward-pointing side of the top wall 60. The indentation 64 has an essentially elliptical outer contour, so that to deploy the carrying handle 62 the user can simply grasp it from behind.

On its front side 66, the housing 10 has two laterally mounted closure units 68, 68' for locking the first housing part 46 to the second housing part 48 (FIG. 1). The closure units 68, 68' each have respective rotary knobs 70, 70', which are let into indentations 72, 72' of the housing 10 and are flush with an outside of the housing 10. For locking the first housing part 46 to the second housing part 48, the rotary knobs 70, 70' of the closure units 68, 68', which knobs are supported on the first housing part 46, are rotated about pivot axes not specifically shown and in the process, they engage half-moon-shaped collars 110, 110', which are formed onto the second housing part 48, from behind. The first housing part 46, on its front side 66, also has two recesses 112, 112', which are embodied with a rectangular cross section. The recesses 112, 112' are embodied in a lower region on the first housing part 46, below the closure units 68, 68'. Fastening elements not shown in detail, in particular screw clamps, can engage the recesses 112, 112', and the first housing part 46 can be secured in slip-proof fashion to a base, such as a tabletop.

Figure 6:
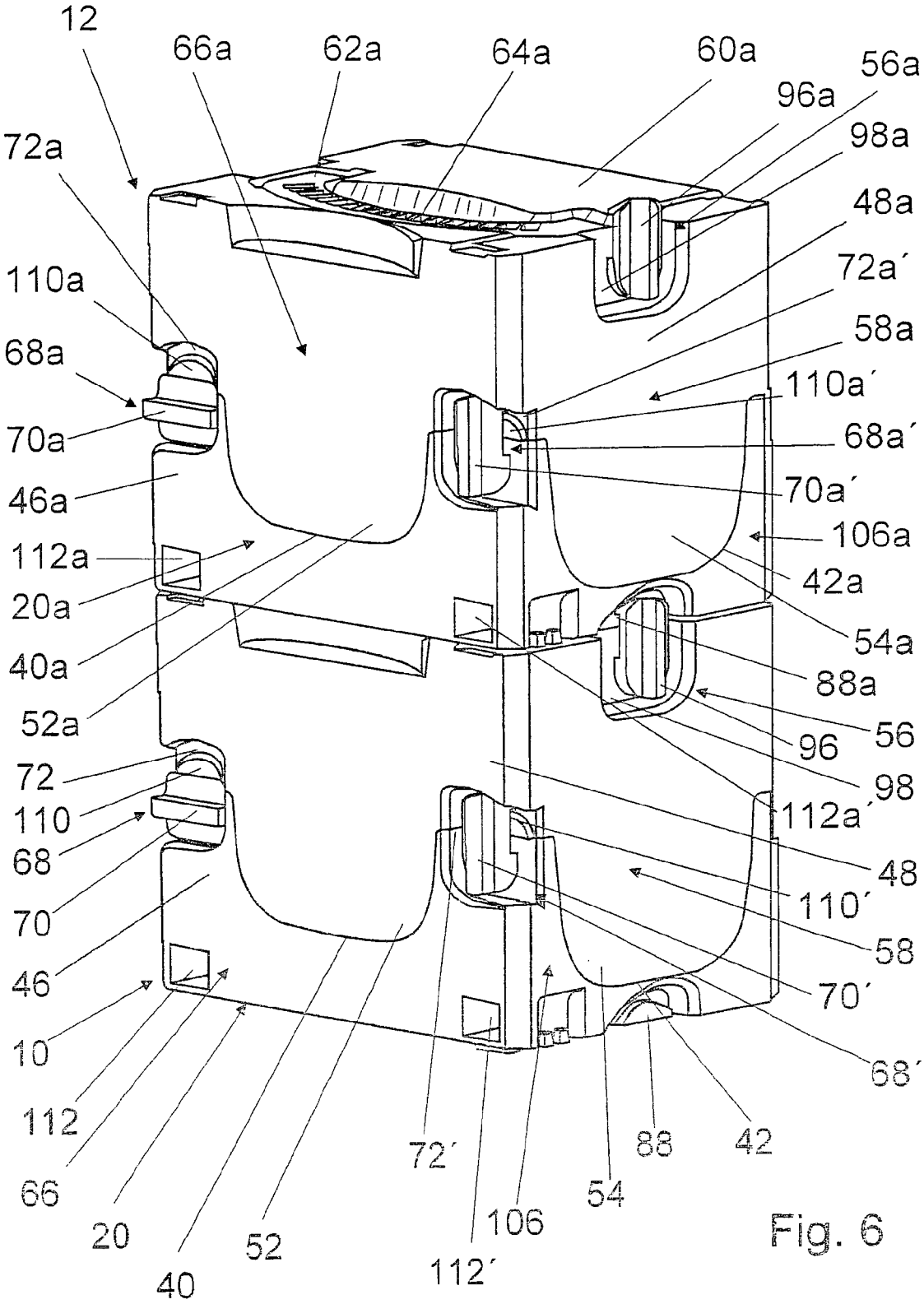
FIG. 6, two manual power tool cases of the invention joined together via a device.

The second housing part 48, on its side walls 58, has a device 56 on top for connection to a first housing part 46 of a further housing 12 (FIG. 6). The device 56 has rotary knobs 96, which are let into indentations 98 in the second housing part 48 and are flush with the outside of the second housing part 48. For connecting the second housing part 48 of the housing 10 to the first housing part 46 of the housing 12, which has the same structural shape as the housing 10, the rotary knobs 96 of the device 56 are rotated, about pivot axes not specifically shown, and in the process engage half-moon-shaped collars 88*a* from behind, the collars being formed onto the first housing part 46 of the second housing 12 and let into indentations.

Figure 3:
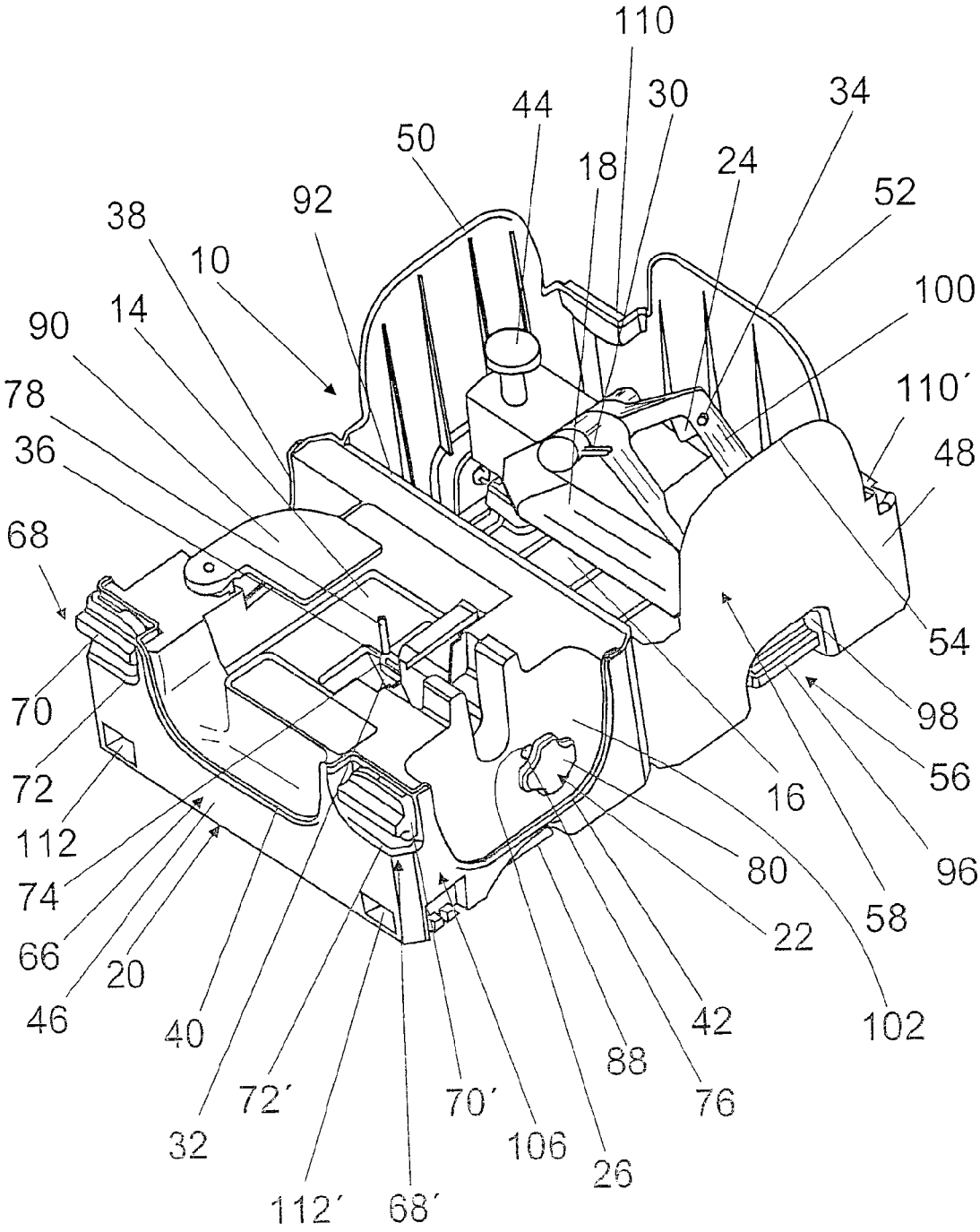
FIG. 3, the manual power tool case of FIG. 2, with the manual power tool in an operation position for mobile operation.
Figure 4:
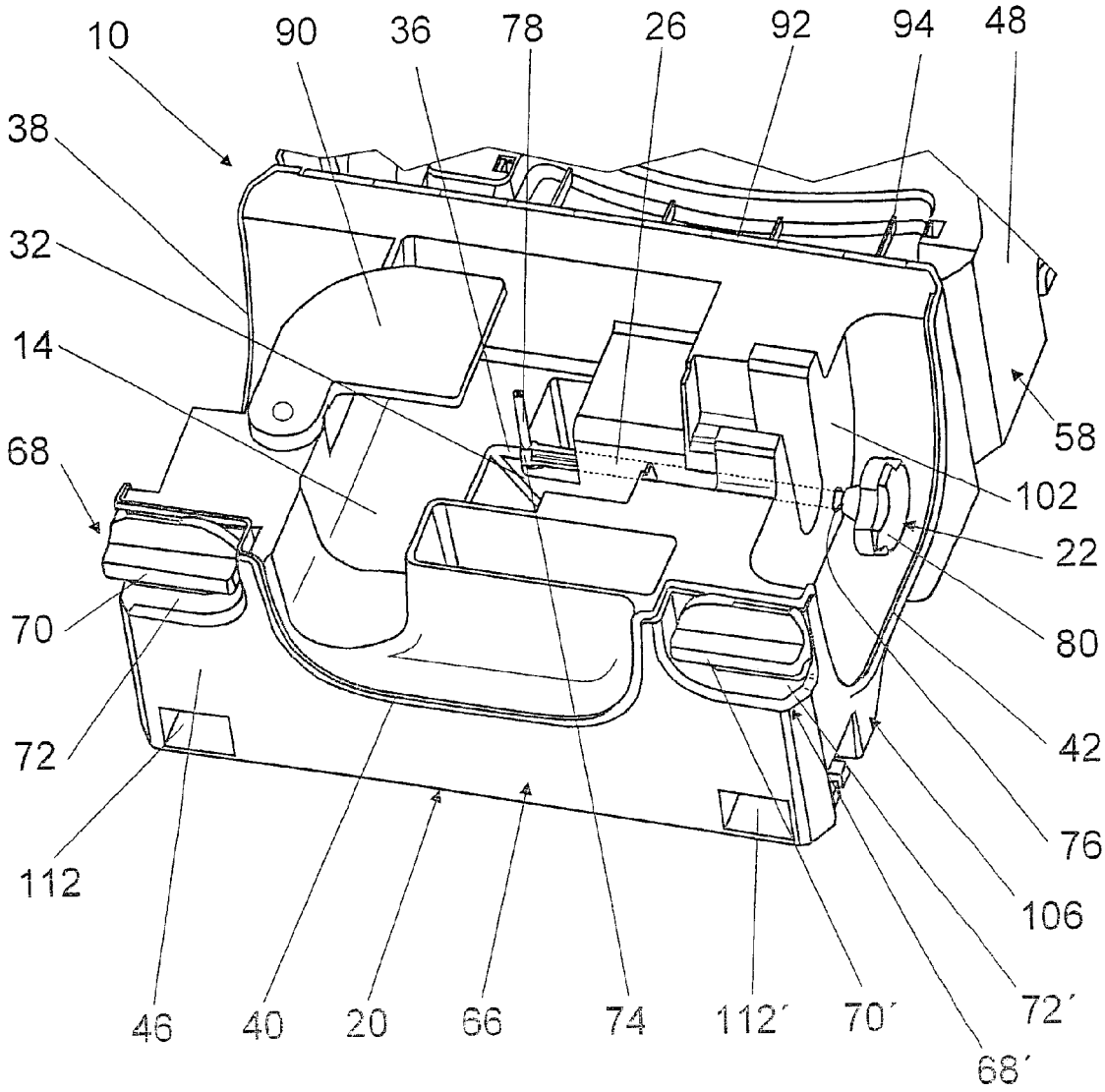
FIG. 4, an enlarged illustration of a first housing part of the manual power tool case.

The first housing part 46 has a storage space 14 for carrying and/or storing a manual power tool 18, specifically for a plane, and forms one part of a base 20 to stand on for stationary operation of the manual power tool 18 (FIGS. 2–4). The first housing part 46, in its storage space 14, has a receptacle region in which the manual power tool 18 is fixable for stationary operation.

If the housing 10 is set down on the first housing part 46, and the second housing part 48 is folded open, then the manual power tool 18 with its housing is located essentially without play in the receptacle region of the first housing part 46, whose design corresponds at least in part to an outer contour of the manual power tool 18. A handle 100 of the manual power tool 18 points downward into the receptacle region, and a work surface 108 of the manual power tool 18 points upward.

The receptacle region has a receptacle element 32 for the handle 100, which in the operating position for the stationary operating mode actuates an unlocking button 34 of the manual power tool 18.

In the storage space 14, the first housing part 46 has a switch device 22, with which an on and off switch 24 of the manual power tool 18 is actuatable during the stationary operating mode. The switch device 22 has a rigid shaft 26, whose first end 74 protrudes into the storage space 14 of the first housing part 46, and whose second end 76, in the open state of the housing 10, protrudes to the outside through a side wall 102 of the first housing part 46.

Figure 5:
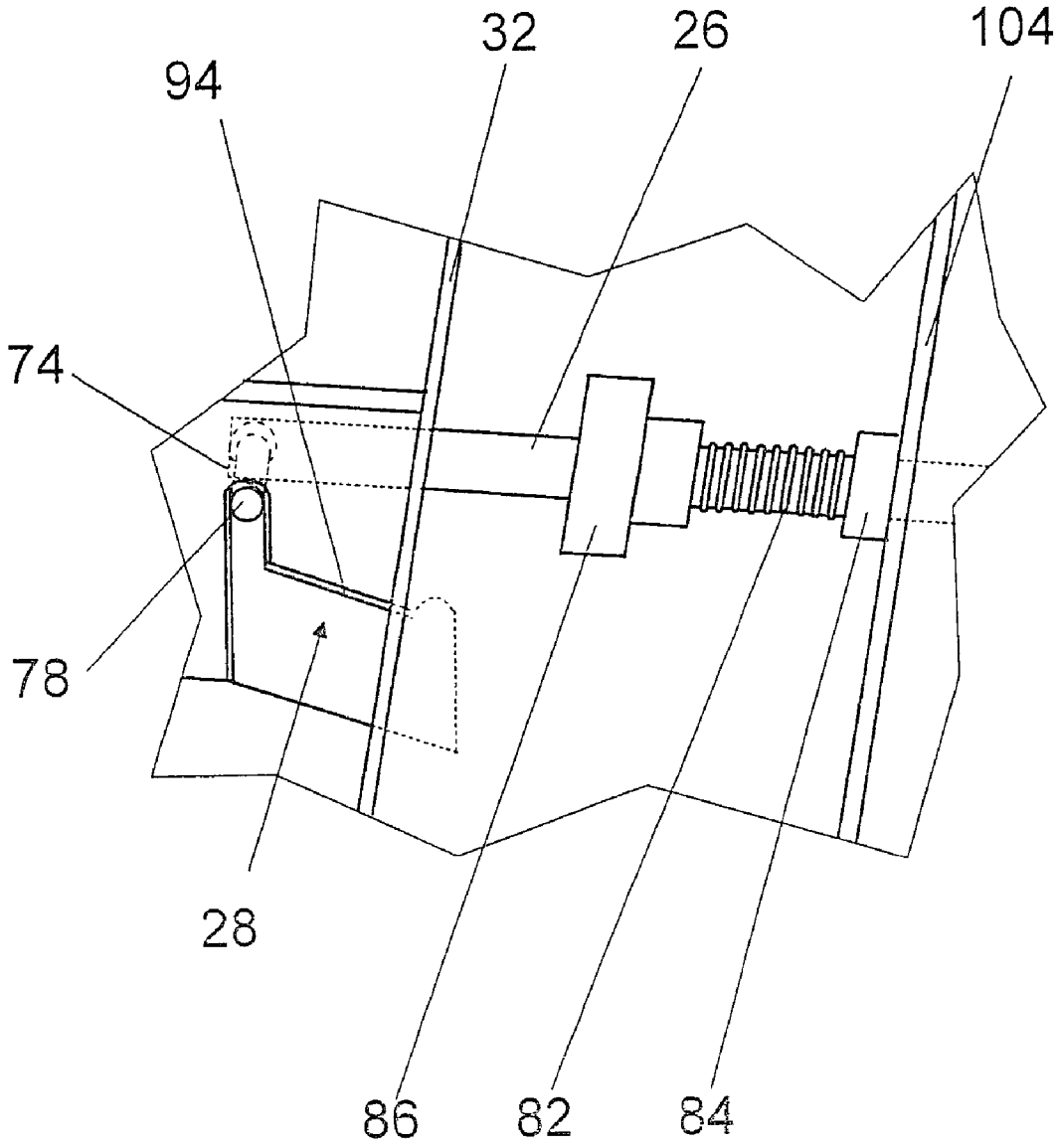
FIG. 5, a simplified detail of a switch device of the manual power tool case.

The rigid shaft 26, on its first end 74, has a fastened transverse pin 78. On the second end 76 of the rigid shaft 26, an actuating element 80 of the switch device 22 is mounted (FIG. 2, FIG. 3 and FIG. 4). The switch device 22 furthermore has a helical compression spring 82 (FIG. 5) disposed on the rigid shaft 26. The helical compression spring 82 is suspended, by its first end pointing in the direction away from the actuating element 80, in a bore, not specifically shown, of a fixation ring 86. The fixation ring 86 is rigidly joined to the rigid shaft 26 in the axial direction and in the direction of rotation. By its second end, pointing in the direction of the actuating element 80, the helical compression spring 80 is guided through a bore, not specifically shown, in a slide ring 84 and is suspended from a peg, not specifically shown, of a housing wall 104. The slide ring 84 is braced on the housing wall 104 by its side pointing in the direction of the actuating element 80, and the rigid shaft 26 is guided displaceably in the slide ring 84. The helical compression spring 80 can be stressed by both compression and torsion.

The storage space 14 furthermore has means 36, formed by a strut, which prevents mispositioning of the manual power tool 18 in the first housing part 46 (FIG. 3 and FIG. 4). The means 36 is attached in such a way that at a suitable position of an actuating lever 30, it prevents a reversal in the direction of chip ejection to chip ejection in the direction of the user and also prevents the manual power tool 18 from being locked in the first housing part 46 and/or the housing 10 from being closed.

An accessory part 90 of the manual power tool 18, specifically a planing knife covering, is mounted on the first housing part 46, on a side facing the actuating element 80 (FIGS. 2–4). The accessory part 90 is connected pivotably to the first housing part 46 via a pivot axis, not specifically shown.

The first housing part 46, on its side parts 106 and on the front side 66, has recesses 38, 40, 42 (FIGS. 2 and 3). On a back side of the first housing part 46, the second housing part 48 is joined in hinged fashion to the first housing part 46 via a hinge 92. During the stationary operating mode of the manual power tool 18, control elements of the manual power tool 18 can be actuated through the recesses 38, 40, 42, an example being a control element 44, specifically a planing thickness adjuster, that is actuated through the recess 38.

The second housing part 48 on its side walls 58 and on its front side 66, has tablike elements 50, 52, 54, which correspond with the recesses 38, 40, 42 of the first housing part 46. Once the first housing part 46 and the second housing part 48 are closed together, the elements 50, 52, 54 of the second housing part 48 positively engage the recesses 38, 40, 42 of the first housing part 46, and the housing parts 46, 48 are flush at their outer surfaces (FIGS. 1 and 6). In the closed state of the housing 10, the actuating element 80 of the switch device 22, mounted in the recess 42 on the second end of the rigid shaft 26, is concealed by the element 54 and is thus protected against damage while being carried around.

For turning on the manual power tool 18, the actuating element 80 of the switch device 22 is pulled out of the housing 10 counter to a spring force of the helical compression spring 82 and rotated about the longitudinal axis of the rigid shaft 26. The transverse pin 78, secured to the first end 74 of the rigid shaft 26, is pivoted as a result of this rotation about the pivot axis of the rigid shaft 26. The first end of the transverse pin 78 is moved along a switching slot 94 of a detent unit 28, while the second end of the transverse pin 78 actuates the on and off switch 24 of the manual power tool 18. As the actuating element and the rigid shaft 26 are pulled out and rotated, the helical compression spring 82 is subjected to compression and torsion via the fixation ring 86. When an end position is reached, the switch device 22, with the first end of the transverse pin 78, engages the detent unit 28, causing the helical compression spring 82 to be under tension. The manual power tool 18 is switched on for stationary operation, and in the ON state it is pressed down via the switch device 22, or via the second end of the transverse pin 78, and is secured in the first housing part 46 via the rigid shaft 26.

For switching the manual power tool 18 off, the user presses lightly on the actuating element 80 of the switch device 22. The first end of the transverse pin 78 becomes disengaged from the detent unit 28, and the spring force of the helical compression spring 82 moves the transverse pin 78 and the rigid shaft 26 of the switch device 22 into their outset positions.

If the housing 10 is placed on the second housing part 48 and the first housing part 46 is folded out to open it, the second housing part 48 in the folded-open state has a storage space 16 for receiving the manual power tool 18 before and after its mobile operation (FIG. 3). The handle 100 of the manual power tool 18 points upward, and the work surface 108 of the manual power tool 18 points downward. The second housing part 48 has ribs that protrude into the storage space 16 and form a receptacle, not specifically shown, into which the manual power tool 18 can be securely deposited and from which the manual power tool 18 can be removed, without striking the sides of the second housing part 48. In the receptacle, the manual power tool 18 is held in such a way that a planing knife of the manual power tool 18 is spaced apart from the second housing part 48, as a result of which damage to the planing knife and to the second housing part 48 is reliably avoided.

The manual power tool 18 is also held in the receptacle formed by the ribs in such a way that the housing 10 can be closed without the first housing part 46 becoming jammed against the manual power tool 18.

List of Reference Numerals

| | |
|---|---|
| 10 | Housing |
| 12 | Housing |
| 14 | Storage space |
| 16 | Storage space |
| 18 | Power tool |
| 20 | Base to stand on |
| 22 | Switch device |
| 24 | Switch |
| 26 | Shaft |
| 28 | Detent unit |
| 30 | Actuating lever |
| 32 | Element |
| 34 | Unlocking button |
| 36 | Means |
| 38 | Recess |
| 40 | Recess |
| 42 | Recess |
| 44 | Control element |
| 46 | Housing part |
| 48 | Housing part |
| 50 | Element |
| 52 | Element |
| 54 | Element |
| 56 | Device |
| 58 | Side wall |
| 60 | Top wall |
| 62 | Carrying handle |
| 64 | Indentation |
| 66 | Front side |
| 68 | closure unit |
| 70 | Rotary knob |
| 72 | Indentation |
| 74 | End |
| 76 | End |
| 78 | Transverse pin |
| 80 | Actuating element |
| 82 | Spring element |
| 84 | Slide ring |
| 86 | Fixation ring |
| 88 | Collar |
| 90 | Accessory part |
| 92 | Hinge |
| 94 | Switching slot |
| 96 | Rotary knob |
| 98 | Indentation |

-continued

| List of Reference Numerals | |
|---|---|
| 100 | Handle |
| 102 | Side wall |
| 104 | housing wall |
| 106 | Side part |
| 108 | work surface |
| 110 | Collar |
| 112 | Recess |

The invention claimed is:

1. A system, comprising a power tool case and a manual power tool (18) detachable from the power tool case for a mobile operation mode, said power tool case having a housing (10,12) that has a storage space (14) for carrying and/or storage of said manual power tool (18), wherein the housing (10, 12) forms at least a part of a base (20) to stand on for a stationary operating mode of the power tool (18), and wherein said housing (10, 12) has at least one switch device (22) which acts mechanically on a switch (24) of the manual power tool (18), wherein said housing (10) has a first housing part (46) and the switch device (22) has a rigid shaft (26) with a first end (74) and a second end (76), said first end protruding into the storage space (14) of the first housing part (46) and said second end (76), in the open state of the housing (10) protrudes to the outside through a side wall (102) of the first housing part (46), wherein the first end (74) is movable relative to the first housing part (46) for mechanically actuating the switch (24) of the manual power tool (18).

2. The system of claim 1, wherein the housing (10, 12) has at least one receptacle region, in which the power tool (18) is fixable for the stationary operating mode.

3. The system of claim 1, wherein the switch (24) is an on and off switch of the power tool (18), and wherein the switch device (22) acts mechanically on the switch (24) of the manual power tool (18) so as to turn the switch (24) on and off.

4. The system, of claim 1, wherein the switch device (22) has a spring element (82), counter to whose spring force an actuating element (80) of the switch device (22) is movable.

5. The system of claim 1, wherein the power tool (18) is secured to the housing (10,12) during the stationary operating mode via the switch device (22).

6. The system of claim 1, wherein during the stationary operating mode of the power tool (18), at least one element (32) of the housing (10, 12) actuates an unlocking button (34) of the power tool (18).

7. The system of claim 1, wherein the housing (10, 12) has at least one means (36) that prevents mispositioning of the power tool (18) in the housing (10, 12).

8. The system of claim 1, wherein the housing (10, 12) has at least one recess (38, 40, 42), by way of which at least one control element (44) of the power tool (18) is actuatable.

9. The system of claim 8, wherein when the housing (10, 12) is closed, the recess (38, 40, 42) is closed by at least one element (50, 52, 54) that corresponds with the recess (38, 40, 42).

10. The system of claim 1, wherein besides a first housing part (46), the housing (10, 12) has a second housing part (48), which parts are joined to one another in hinged fashion and have the same height.

11. The system of claim 10, wherein the first and second housing parts (46, 48), in the opened state, are fixable relative to one another in at least one position.

12. The system of claim 1, wherein at least one accessory part (90) of the power tool (18) is integrated with the housing (10, 12).

13. The system of claim 1, wherein the housing (10) has at least one rotary knob (96, 98) for joining it to at least one further housing (12).

14. The system of claim 1, wherein said switch is actuatable by said switch device (22) in the stationary operation mode.

15. The system of claim 1, wherein said manual power tool (18) has a handle (100) for mobile operation and said on and off switch (24) is arranged at said handle (100).

16. The system of claim 1, wherein said manual power tool (18) has a planing knife, wherein a planing knife covering is integrated with the housing (10, 12), and wherein said planing knife covering covers the planing knife in an open state of the housing.

17. The system of claim 16, wherein said planing knife covering is pivotable to a first housing part (46) of the housing (10, 12) via a pivot axis.

* * * * *